US005675239A

United States Patent [19]

Kim et al.

[11] Patent Number: 5,675,239

[45] Date of Patent: Oct. 7, 1997

[54] VOLTAGE BALANCING CIRCUIT

[75] Inventors: Yong-Ho Kim, Seoul; Young-sik Lee, Kyungki-do, both of Rep. of Korea

[73] Assignee: Samsung Electronics Co., Ltd., Suwon, Rep. of Korea

[21] Appl. No.: 637,570

[22] Filed: Apr. 25, 1996

[30] Foreign Application Priority Data

Apr. 27, 1995 [KR] Rep. of Korea ..... 95-10088

[51] Int. Cl.[6] ..... G05F 1/40

[52] U.S. Cl. ..... 323/273

[58] Field of Search ..... 323/273

[56] References Cited

U.S. PATENT DOCUMENTS 3,886,436 5/1975 Wadlington ..... 323/225

*Primary Examiner*—Stuart N. Hecker

*Attorney, Agent, or Firm*—Marger, Johnson, McCollom & Stolowitz, P.C.

[57] ABSTRACT

A voltage balancing circuit and methods are disclosed for providing power from a single DC power supply to a circuit, such as an integrated circuit, that presents both a positive load and a negative load to the power supply, while ensuring that the positive load voltage and the negative load voltage remains substantially equal in magnitude, notwithstanding variations in the magnitudes of the loads. A voltage divider circuit provides a reference voltage equal to one-half of the total power supply voltage. Capacitors are provided across each of the positive and negative loads.

11 Claims, 2 Drawing Sheets

VOLTAGE BALANCING CIRCUIT

FIELD OF THE INVENTION

The present invention relates to a power balancing circuit and more specifically, to methods and apparatus for providing DC power to a positive load and to a negative load from a single power supply so as to ensure that the voltages applied to the positive and negative loads remain equal in magnitude notwithstanding variations in the loading imposed by each of the positive and negative loads on the power supply.

BACKGROUND OF THE INVENTION

Integrated circuits are known in which both positive and negative supplies are required for proper operation. However, some integrated circuits generate the positive and negative supplies internally, so that only a single external power supply is required. To ensure that both the positive and negative internal supplies have the same magnitude, a voltage balancing circuit is required. Operational amplifiers, for example, require both positive and negative supplies. If the supply voltages are not balanced, an output offset voltage can result with a corresponding loss in accuracy in operation of the operational amplifier.

SUMMARY OF THE INVENTION

Accordingly, a principle object of the present invention is to provide a voltage balancing circuit for providing power to a positive load and to a negative load from a single power supply, while ensuring that the respective voltages applied to the positive and negative loads remain substantially equal in magnitude. In this description, we assume that a DC power supply has first and second power supply terminals, and provides a supply voltage across those terminals. The positive load and the negative load are coupled in series across the power supply terminals, as illustrated in FIG. 1. A common node intermediate the positive load and the negative load is connected to ground.

According to the invention, a voltage balancing circuit includes a reference voltage circuit connected across the power supply terminals to provide a reference voltage equal to one-half of the total power supply voltage. First and second capacitors having equal capacitances are disposed in series across the power supply terminals. A common capacitor node intermediate the first and second capacitors is coupled to ground. Thus it may be observed that the first and second capacitors are arranged in parallel to the positive load and the negative load, respectively. An amplifier is provided for comparing the common capacitor ground node voltage to the reference voltage and providing an error signal responsive to a difference between the ground voltage and the reference voltage. Finally, an amplifier responsive to the error signal is arranged for driving the ground node voltage toward the reference voltage so as to reduce the error signal to a minimum when the ground voltage is equal to the reference voltage. In other words, by adjusting the ground voltage level so that it is always centered between the power supply terminal voltages, the voltages applied to the positive load and the negative load will remain substantially equal in magnitude.

In a preferred embodiment, the reference voltage is determined by a resistive divider circuit. The ground voltage and the reference voltage are compared using an operational amplifier. And the amplifier means responsive to the error signal for driving the ground voltage towards the reference voltage preferably is implemented as a bipolar transistor. Either an NPN or a PNP transistor can be used, with the circuit modified accordingly, as will be described later. Additionally, zener diodes can be used for clamping the positive and negative load voltages so that they do not exceed predetermined zener voltages.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
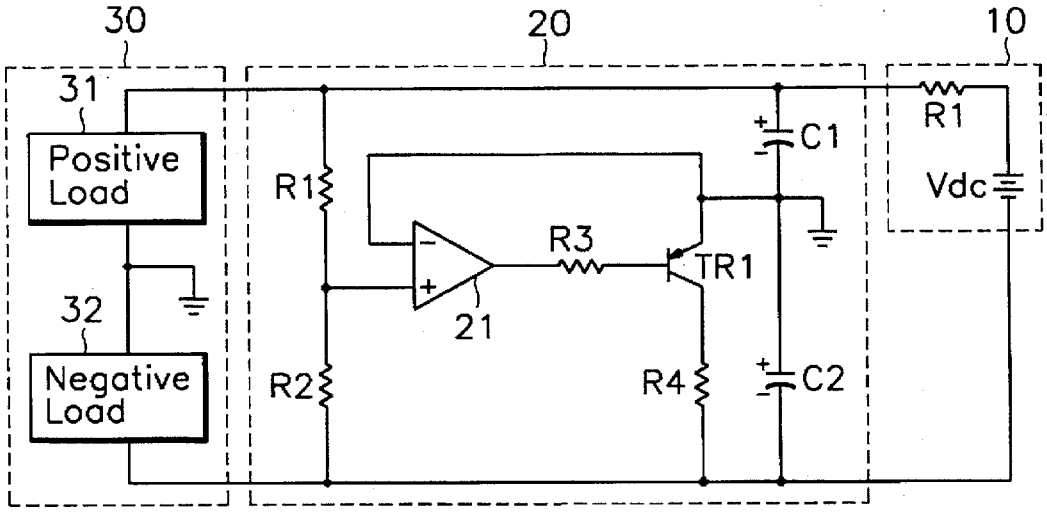
FIG. 1 is a schematic diagram illustrating one embodiment of a power balancing circuit according to the invention.

Referring to FIG. 1, a voltage balancing circuit 20 according to the present invention is shown in a typical application. The balancing circuit 20 is coupled to a power supply 10 and coupled to a load ckt. 30. Load ckt. 30 includes a positive load 31 coupled between a first one of the power supply terminals and ground, and a negative load 32 coupled between ground and the second power supply terminal. A reference voltage VREF is provided by a voltage divider circuit consisting of resistors R1 and R2 connected in series across the power supply terminals. Capacitors C1 and C2 also are connected in series across the power supply terminals. Capacitor C1 and C2 have equal capacitances. A common capacitor node intermediate C1 and C2 is coupled to ground.

The power supply circuit 10 provides nominal voltage Vdc and has an internal resistance indicated by R1. A first one of the power supply terminals, having the more positive voltage, is labeled (+) and the second power supply terminal, having the lower voltage, is labeled with (−). An operational amplifier 21 has a noninverting (+) input coupled to VREF and an inverting (−) input coupled to the ground node between capacitor C1 and C2. The output of the operational amplifier is coupled through resistor R3 to the base of PNP transistor TR1. The emitter of transistor TR1 is coupled to the ground node between the capacitors C1 and C2, while the collector terminal of transistor TR1 is coupled through resistor R4 to the second power supply terminal.

In operation of the circuit of FIG. 1, the resistive divider R1,R2 provides a constant VREF equal to one-half of the total power supply voltage that appears between the (+) and (−) power supply terminals. Operational amplifier 21 compares VREF to the ground node voltage and, to the extent there is a difference therebetween, generates an error signal at the operational amplifier terminal. The error signal is applied to the base of transistor TR1 (through resistor R3) and controls the transistor so that it drives the ground node voltage towards the reference voltage. For example, if the ground node voltage rises above the reference voltage, the error signal voltage will move downward, thereby turning transistor TR1 ON. Turning TR1 ON will provide current flow through R4 and drive the ground node voltage lower. Lowering the ground node voltage comprises increasing the voltage across C1 while reducing the voltage across C2.

Conversely, when the ground voltage falls below the reference voltage VREF, the error signal voltage will rise, tending to turn transistor TR1 OFF, and thereby raising the ground node voltage. The error signal will be at a minimum when the ground voltage is substantially equal to the reference voltage. Since the reference voltage is substantially equal to one-half of the total power supply voltage, this will ensure that a first voltage applied across the positive load 31 will remain substantially equal in magnitude to the second voltage applied across the negative load 32.

Figure 2:
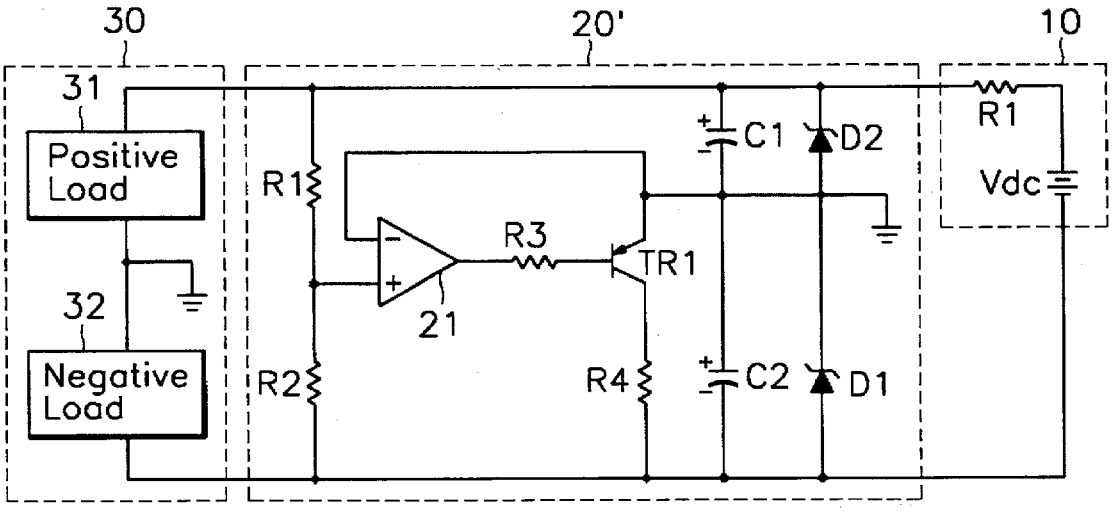
FIG. 2 is a schematic diagram illustrating an alternative embodiment of the invention.

FIG. 2 illustrates a second embodiment of the invention. FIG. 2 is the same as FIG. 1, except for the addition of first and second zener diodes D1 and D2 which are connected in parallel to capacitors C1 and C2, respectively. Each zener diode clamps the corresponding capacitor voltage so that it cannot exceed a predetermined limit, namely the zener voltage of the corresponding zener diode. The zener diodes thus can be used to clamp either or both of the positive load voltage and the negative load voltage so they do not exceed predetermined maximum values. The zener voltages need not necessarily be the same. Since the capacitors C1 and C2 are identical, the zener diodes D1 and D2 are likely to be the same if their predominant purpose is to protect the capacitors from overcharging. On the other hand, where capacitor breakdown is not a concern, the zener diodes may be used to protect the loads from power supply overvoltage conditions.

Figure 4:
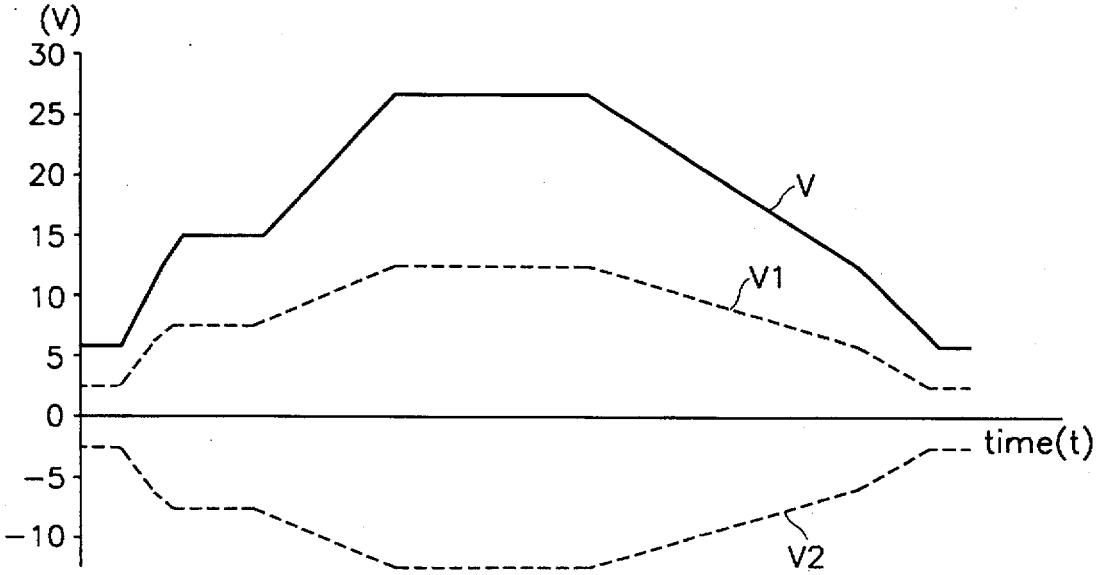
FIG. 4 is a voltage plot illustrating operation of a voltage balancing circuit of the type illustrated in FIG. 1.

FIG. 4 is a voltage plot illustrating operation of the voltage balancing circuits of FIGS. 1 and 2. In FIG. 4, V indicates the total power supply voltage provided by the power supply 10. V1 indicates the voltage applied to the positive load 31 and V2 indicates the voltage applied to the negative load 32. It may be observed in the drawing that even though the power supply voltage V varies considerably over time, the positive load voltage V1 and the negative load voltage V2 are maintained in substantially equal magnitudes.

Figure 3:
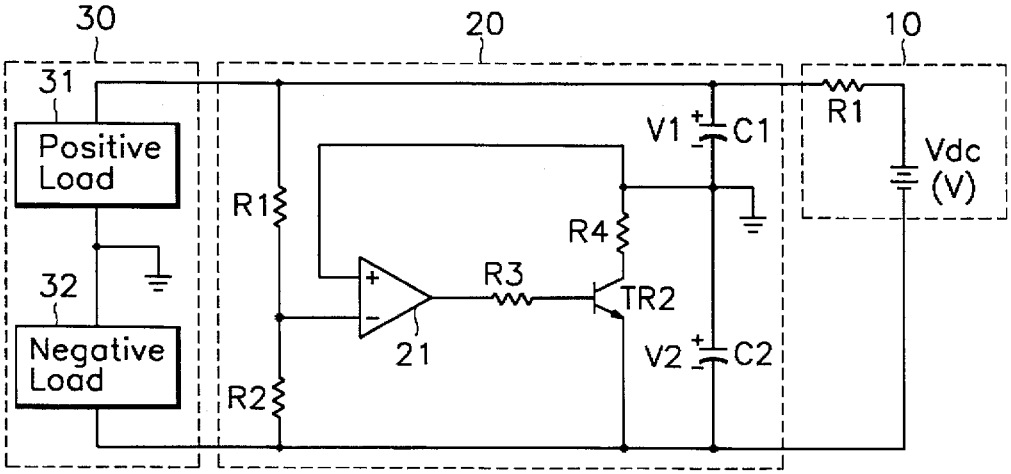
FIG. 3 is a schematic diagram illustrating a second alternative embodiment of the invention.

FIG. 3 shows another alternative embodiment of the invention, in which an NPN transistor TR2 serves as the error amplifier instead of the PNP transistor shown in the circuits of FIGS. 1 and 2. The NPN transistor TR2 has its collector terminal coupled to the common capacitor ground node through a current limit resistor R4. The emitter terminal TR2 is coupled to the second (–) power supply terminal. Operation of the circuit is generally the same as described previously.

Variations on the preferred embodiment will be apparent to those skilled in the art in view of the present disclosure. For example, means for determining the reference voltage are not limited to a passive voltage divider, as illustrated. Other voltage divider circuitry could be used, including alternative impedance elements in lieu of resistors. Other differential amplifiers can be used to provide the comparator function of operational amplifier 21. Moreover, other types of voltage-control current sources could be used instead of a bipolar transistor for adjusting the ground node voltage in response to the error signal.

Having illustrated and described the principles of my invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A voltage balancing circuit for providing power to a positive load and to a negative load from a single power supply having first and second power supply terminals, the power supply providing a supply voltage across the terminals, the positive load and the negative load being coupled in series across the power supply terminals, and having a common node intermediate the positive load and the negative load connected to ground, the voltage balancing circuit comprising:

reference voltage means for providing a reference voltage equal to one-half of the power supply voltage;

first and second capacitors disposed in series across the power supply terminals, the first and second capacitors having equal capacitances, and having a common capacitor node intermediate the first and second capacitors coupled to ground;

means for comparing the common capacitor node voltage to the reference voltage and providing an error signal responsive to a difference between the common capacitor node voltage and the reference voltage, said comparing means comprising an operational amplifier having a first input terminal coupled to the common capacitor node, a second input terminal coupled to the reference voltage and an output terminal coupled to the amplifier means to provide the error signal;

amplifier means responsive to the error signal for driving the common capacitor node ground voltage toward the reference voltage so as to reduce the error signal to a minimum when the ground voltage is equal to the reference voltage, thereby ensuring that a first voltage applied to the positive load and a second voltage applied to the negative load remain substantially equal in magnitude, said amplifier means comprising a transistor arranged to control current flow between the common capacitor ground node and a selected one of the power supply terminals, the transistor having a base terminal coupled to the operational amplifier output terminal for controlling the transistor responsive to the error signal; and a voltage clamping means for clamping the first and second voltages so as to not exceed a predetermined voltage, said voltage clamping means comprising first and second zener diodes arranged in parallel to the first and second capacitors, respectively.

2. A voltage balancing circuit according to claim 1 wherein the reference voltage means comprises first and second impedance elements disposed in series across the power supply terminals, the first and second impedance elements having equal impedances and arranged to provide the reference voltage at a reference voltage node intermediate the first and second impedance elements.

3. A voltage balancing circuit according to claim 2 wherein the first and second impedance elements comprise resistors of equal resistance.

4. A voltage balancing circuit according to claim 1 wherein the amplifier means includes a voltage-controlled current source for controlling current flow between the common capacitor ground node and a selected one of the power supply terminals responsive to the error signal.

5. A voltage balancing circuit according to claim 1 wherein the second capacitor is disposed between ground and the second power supply terminal and the transistor is an PNP transistor having an emitter terminal coupled to ground node and a collector terminal coupled to the second power supply terminal for controlling charging and discharging of the second capacitor, thereby adjusting the ground voltage in response to the error signal.

6. A voltage balancing circuit according to claim 1 wherein the second capacitor is disposed between ground and the second power supply terminal and the transistor is an NPN transistor having an collector terminal coupled to the ground node and an emitter terminal coupled to the second power supply terminal for charging and discharging the first and second capacitors, thereby adjusting the ground voltage, in response to the error signal.

7. A voltage balancing circuit for providing power from a single DC power supply to an integrated circuit that presents both a positive load and to a negative load to the power supply, the power supply having first and second power supply terminals, and providing a substantially constant supply voltage across the terminals, the integrated circuit being connected to the power supply such that the positive load and the negative load are coupled in series across the power supply terminals, a common node intermediate the positive load and the negative load being connected to ground, the voltage balancing circuit comprising:

a resistive voltage divider circuit connected across the power supply terminals to provide a reference voltage equal to one-half of the total power supply voltage;

first and second capacitors disposed in series across the power supply terminals, the first and second capacitors having equal capacitances, and a common capacitor node intermediate the first and second capacitors being coupled to a ground node, whereby the first and second capacitors are connected in parallel with the positive load and the negative load, respectively;

an operational amplifier arranged for comparing the ground node voltage to the reference voltage and providing an error signal responsive to a difference between the ground node voltage and the reference voltage;

a resistor having one side connected to one of said first and second power supply terminals; and a transistor having a first side connected to the ground node and a second side connected to the other side of said resistor, the transistor further having a base terminal coupled to receive the error signal so that the transistor drives the ground node voltage toward the reference voltage, thereby ensuring that a first voltage applied to the positive load and a second voltage applied to the negative load remain substantially equal in magnitude and the sum of the magnitudes of the first and second voltages remains substantially constant.

8. A voltage balancing circuit according to claim 7 further comprising first and second zener diodes arranged in parallel to the first and second capacitors, respectively, for clamping the first and second voltages, respectively, to a predetermined zener diode voltage.

9. A voltage balancing circuit according to claim 7 wherein the operational amplifier has an inverting input coupled to the reference voltage and has a non-inverting input coupled to the ground node intermediate the first and second capacitors, and the operational amplifier has an output terminal for providing the error signal to the said transistor.

10. A voltage balancing circuit for providing power from a single DC power supply to an integrated circuit that presents both a positive load and to a negative load to the power supply, the power supply having first and second power supply terminals, and providing a supply voltage across the terminals, the integrated circuit being connected to the power supply such that the positive load and the negative load are coupled in series across the power supply terminals, a common node intermediate the positive load and the negative load being connected to ground, the voltage balancing circuit comprising:

a resistive voltage divider circuit connected across the power supply terminals to provide a reference voltage equal to one-half of the total power supply voltage;

first and second capacitors disposed in series across the power supply terminals, the first and second capacitors having equal capacitances, and a common capacitor node intermediate the first and second capacitors being coupled to a ground node, whereby the first and second capacitors are connected in parallel with the positive load and the negative load, respectively;

an operational amplifier arranged for comparing the ground node voltage to the reference voltage and providing an error signal responsive to a difference between the ground node voltage and the reference voltage;

a transistor coupled between the ground node and one of said power supply terminals, the transistor further having a base terminal coupled to receive the error signal so that the transistor drives the ground node voltage toward the reference voltage, thereby ensuring that a first voltage applied to the positive load and a second voltage applied to the negative load remain substantially equal in magnitude; and first and second zener diodes arranged in parallel to the first and second capacitors, respectively, for clamping the first and second voltages, respectively, to a predetermined zener diode voltage.

11. A voltage balancing circuit according to claim 10 wherein the operational amplifier has an inverting input coupled to the reference voltage and has a non-inverting input coupled to the ground node intermediate the first and second capacitors, and the operational amplifier has an output terminal for providing the error signal to the said transistor.

* * * * *